US007040567B1

(12) United States Patent
Lewis et al.

(10) Patent No.: US 7,040,567 B1
(45) Date of Patent: May 9, 2006

(54) DISPENSER FOR PERFORATED SHEET MATERIAL PROVIDING FLAT SHEET DELIVERY

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/025,392

(22) Filed: Dec. 29, 2004

(51) Int. Cl.
*B65H 16/02* (2006.01)
*B65D 85/66* (2006.01)

(52) U.S. Cl. ..... 242/588.3; 242/594.1; 206/408; 206/409

(58) Field of Classification Search ..... 242/588, 242/588.3, 588.4, 594.1, 595, 598.6; 206/389, 206/398, 403, 408, 409
See application file for complete search history.

(56) References Cited

U.S. PATENT DOCUMENTS

| | | | | | |
|---|---|---|---|---|---|
| 2,340,116 | A | * | 1/1944 | Ferguson et al. | 206/408 |
| 3,166,187 | A | * | 1/1965 | Araujo | 206/409 |
| 3,276,575 | A | * | 10/1966 | Sanderson | 242/595 |
| 3,302,781 | A | * | 2/1967 | Rudnick | 206/408 |
| 3,770,172 | A | | 11/1973 | Nystrand et al. | |
| 3,877,576 | A | | 4/1975 | Kishi et al. | |
| 3,958,768 | A | * | 5/1976 | Fairbanks | 242/595 |
| 3,998,326 | A | * | 12/1976 | McKee, Jr. | 206/389 |
| 4,027,794 | A | * | 6/1977 | Olson | 206/403 |
| 4,467,974 | A | * | 8/1984 | Crim | 242/595 |
| 4,805,794 | A | * | 2/1989 | Tsuchiya et al. | 206/408 |
| 4,901,855 | A | * | 2/1990 | Furukawa | 206/389 |
| 5,048,589 | A | | 9/1991 | Cook et al. | |
| 5,399,412 | A | | 3/1995 | Sudall et al. | |
| 5,507,386 | A | * | 4/1996 | Foote | 206/409 |
| 5,570,856 | A | * | 11/1996 | Sharpe | 242/588.3 |
| 5,674,590 | A | | 10/1997 | Anderson et al. | |
| 5,772,845 | A | | 6/1998 | Farrington, Jr. et al. | |
| 5,904,971 | A | | 5/1999 | Anderson et al. | |
| 6,179,244 | B1 | * | 1/2001 | Rodriguez | 206/408 |
| 6,248,212 | B1 | | 6/2001 | Anderson et al. | |
| 6,273,996 | B1 | | 8/2001 | Hollenberg et al. | |

FOREIGN PATENT DOCUMENTS

GB 2308114 6/1997

OTHER PUBLICATIONS

ASTM Designation: D 3776-96, "Standard Test Method for Mass Per Unit Area (Weight) of Fabric", Published Jun. 1996, pp. 86-89.
ASTM Designation: D 5035-95, "Standard Test Method for Breaking Force and Elongation of Textile Fabrics (Strip Method)", Published Jul. 1995, pp. 682-688.
TAPPI Test Method T411 om-89, "Thickness (caliper) of Paper, Paperboard, and Combined Board", 1989, pp. 1-3.

* cited by examiner (Continued)

*Primary Examiner*—William A. Rivera
(74) *Attorney, Agent, or Firm*—Sue C. Watson

(57) ABSTRACT

A disposable dispenser adapted to dispense sheet material is provided. The dispenser includes a housing configured to provide a shipping carton for a roll of sheet material as well as a dispenser housing for dispensing sheets of material therefrom. The housing includes a tray configured to support sheet material thereon. The tray includes a dispensing opening. The housing is formed to include an exit port spaced apart from the tray. Sheet material disposed in the dispenser follows a circuitous path between the opening in the tray and through the exit port in a substantially flat configuration. A system for providing a disposable dispenser and a roll of sheet material.

30 Claims, 8 Drawing Sheets

DISPENSER FOR PERFORATED SHEET MATERIAL PROVIDING FLAT SHEET DELIVERY

BACKGROUND

The present invention relates to a dispenser of material, such as, for example, sheet material. In addition, the present invention relates to a dispenser in which a sheet of material is removed from an exit port of the dispenser without a patron having to touch the dispenser to obtain or remove the sheet.

No-touch dispensers, i.e., dispensers that do not require the patron to touch any part of the dispenser, are desired for many reasons. No-touch dispensing reduces the chance of transferring disease-causing bacteria, viruses and other microorganisms. No-touch dispensing also makes the process of obtaining a sheet simpler and quicker.

Single-sheet dispensers, i.e., dispensers that dispense a consistent, fixed quantity of sheet material, are also desired for many reasons. They tend to reduce the quantity of sheet material used by an individual patron, thereby saving on material costs, disposal costs, and costs associated with the frequency whereby the dispensers must be refilled.

No-touch, single-sheet dispensers for folded, interleaved sheets are known, however the manufacturing processes associated with providing the folded, interleaved sheets are more expensive and complex than the process associated with providing roll products.

No-touch, single-sheet dispensers utilizing knives or other cutting devices to cut sheet material from a roll of sheet material are known, but knives and other cutting devices may present a danger to either a patron or an individual refilling the dispenser.

No-touch, single-sheet dispensers for rolled products via zones of weakness, such as, but not by way of limitation, perforations, are known, but if the sheet material tears before the next zone of weakness emerges from the dispenser, the next patron has no sheet material to grasp.

No-touch, single-sheet dispensing of double rolled products via offset zones of weakness (such as, for example, perforations) is also known, but dispensers for these products still have disadvantages that have yet to be overcome. As an example, these dispensers can be difficult to load. As another example, if the force applied by a patron to remove the sheet material from the dispenser is distributed evenly across the width of the sheet material, the zones of weakness may not separate, causing more than one sheet to be removed from the dispenser.

These types of dispensers are ideal for use in an industrial or commercial environment. Dispensers of such rolls, however, quickly become dirty, worn, and so forth. It would therefore be desirable to have a single use, disposable dispenser to dispense such rolls. Such a dispenser would provide one or more mechanisms to appropriately tension the sheet material flowing therethrough to allow withdrawal of one sheet at a time from a roll of sheet material to prevent both user waste from excessive dispensing and user frustration from inadequate dispensing. Such a dispenser may also desirably provide both a shipping carton for the sheet material contained therein as well as a single use, disposable dispenser. Such a dispenser would permit easy transport and storage as well as proper dispensing.

SUMMARY OF THE INVENTION

In response to the difficulties and problems discussed above, a disposable dispenser adapted to dispense sheet material is provided. The dispenser comprises a housing configured to provide a shipping carton for a roll of sheet material as well as a dispenser housing for dispensing sheets of material therefrom. The housing includes a tray configured to support sheet material thereon. The tray includes a dispensing opening positioned on a first axis. The housing is formed to include an exit port spaced apart from the tray. The exit port is positioned on a second axis. Sheet material disposed in the dispenser flows between the opening in the tray and the exit port on a third axis in a substantially flat configuration.

In another aspect of the invention, a disposable dispenser adapted to dispense sheet material is provided. The dispenser includes a housing configured to provide a shipping carton for a roll of sheet material as well as a dispenser housing for dispensing sheets of material therefrom. The housing includes a tray configured to support sheet material thereon. The tray includes a dispensing opening. The housing is formed to include an exit port spaced apart from the tray. Sheet material disposed in the dispenser follows a circuitous path between the opening in the tray and through the exit port in a substantially flat configuration.

In yet another aspect of the invention, a system is provided. The system includes a disposable dispenser for dispensing sheet material. The dispenser comprises a housing configured to provide a shipping carton for a roll of sheet material as well as a dispenser housing for dispensing sheets of material therefrom. The housing includes a tray configured to support sheet material thereon. The tray includes a dispensing opening. The housing is formed to include an exit port spaced apart from the tray. Sheet material disposed in the dispenser follows a circuitous path between the opening in the tray and through the exit port in a substantially flat configuration. The system also includes a roll of sheet material positioned on the tray.

Other features and aspects of the present invention are discussed in greater detail below.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As user herein, the term "couple" includes, but is not limited to, joining, connecting, fastening, linking, or associating two things integrally or interstitially together.

These terms may be defined with additional language in the remaining portions of the specification.

DETAILED DESCRIPTION

Figure 1:
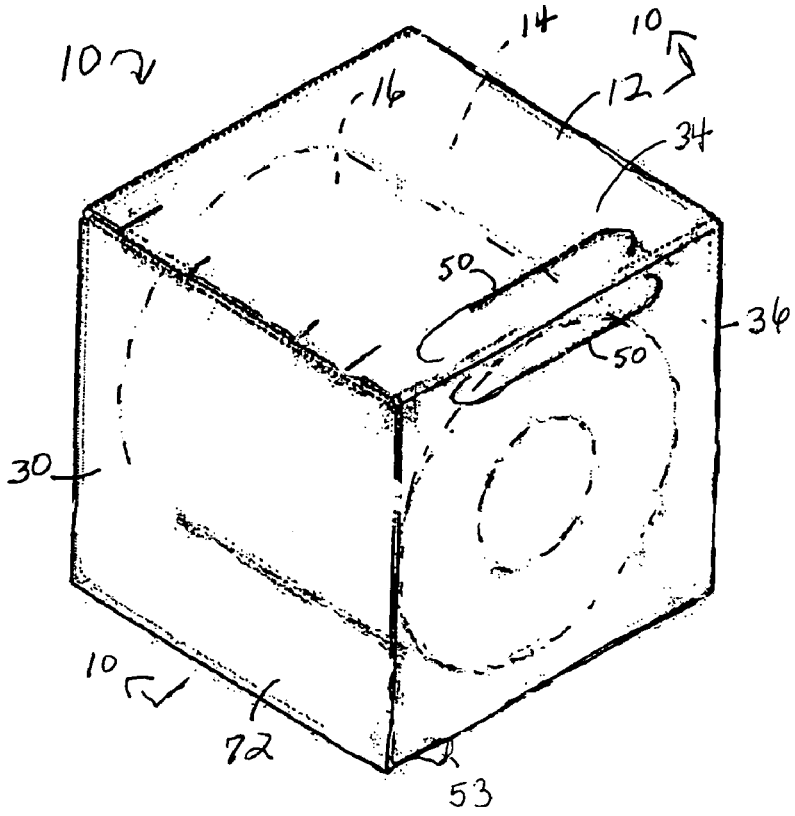
FIG. 1 is a perspective view of a dispenser of the present invention, showing a front side and an upper end of the dispenser and a roll of sheet material illustrated by phantom lines.

Reference will now be made in detail to the various embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

The present invention provides an apparatus for dispensing rolled material. Such rolled material may include, but is not limited to, woven materials, nonwoven materials, synthetic materials, natural materials, foils, polymer films, any combination thereof, and so forth. Desirably, the rolled material is provided as a sheet material within a roll. Exemplary sheet materials for which the present invention is suitable include, but are not limited to, absorbent sheet materials such as towels, wipers, tissue, and so forth. Suitable sheet materials are disclosed, by way of non-limiting examples only, in U.S. Pat. No. 5,048,589 to Cook et al., U.S. Pat. No. 5,399,412 to Sudall et al., U.S. Pat. No. 5,674,590 to Anderson et al., U.S. Pat. No. 5,772,845 to Farrington, Jr. et al., U.S. Pat. No. 5,904,971 to Anderson et al., U.S. Pat. No. 6,248,212 to Anderson et al., and U.S. Pat. No. 6,273,996 to Hollenberg et al., the entire contents of which are herein incorporated by reference. The sheet materials for which the present invention is suitable may be wound around a core. Alternatively, the sheet materials are wound into a coreless roll. The sheet materials for which the present invention is suitable desirably have regularly spaced zones of weakness extending substantially across the width of the sheet material. The zones of weakness are used to separate the sheet material into individual sheets and may be, for example, but not by way of limitation, defined by a series of perforations, a zone of much lower basis weight, and so forth. The sheet material having regularly spaced zones of weakness substantially extending across its width is desirably double wound into a roll having inner and outer layers of sheet material wherein the zones of weakness for the inner and outer layers are offset as is taught in U.S. Pat. No. 3,770,172 and U.S. Pat. No. 3,877,576, both of which are herein incorporated by reference in their entirety. Double wound sheet material having offset zones of weakness allows the sheet material to tear within the dispenser while still providing a tail of sheet material extending from the dispenser to be grasped by the next patron or user.

Figure 9A:
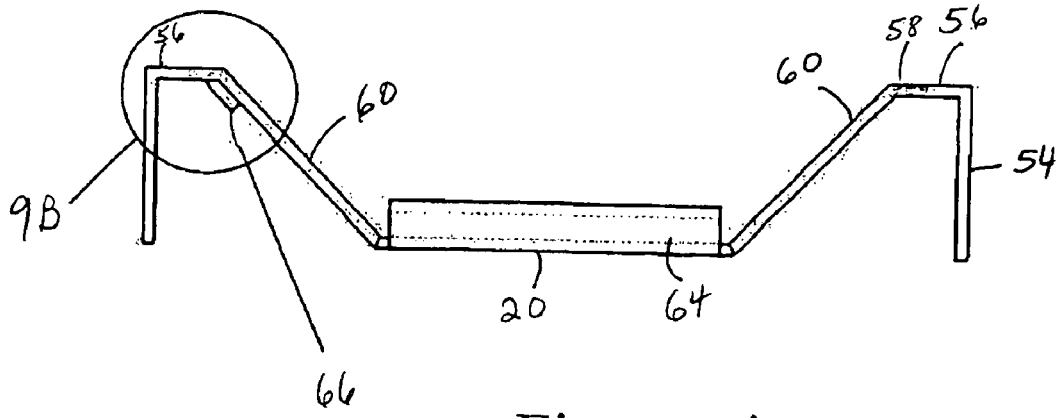
FIG. 9A is a sectional view of FIG. 8B taken along lines 9A—9A, showing a tab of a perforated section opened and moved downward to provide a curved, radiused surface.
Figure 9B:
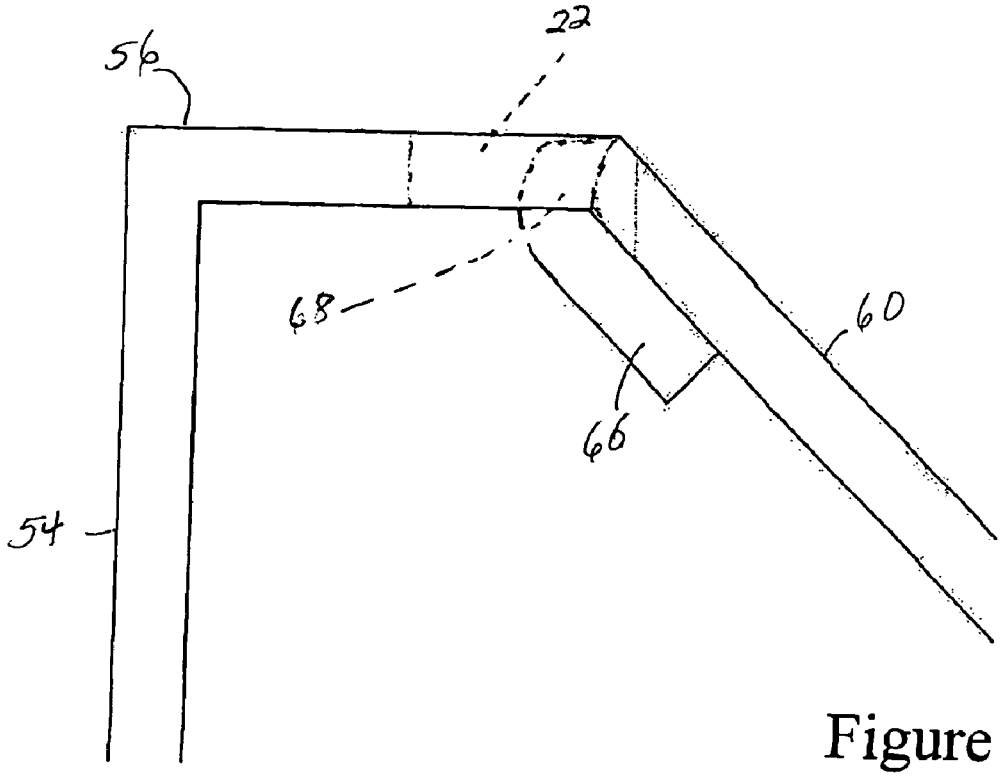
FIG. 9B is a partial view of FIG. 9A, taken along line 9B.
Figure 10:
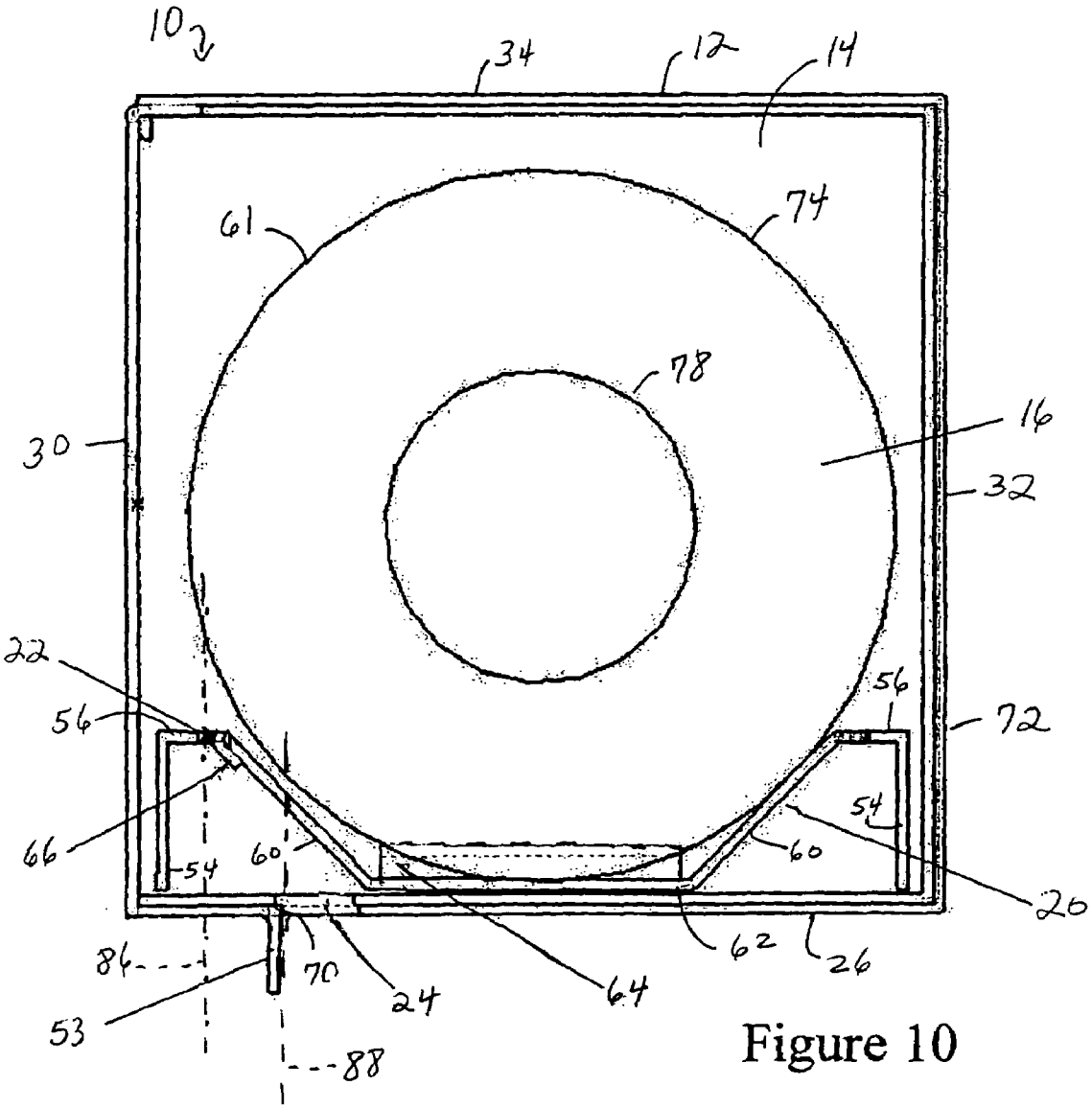
FIG. 10 is a sectional view of FIG. 1 taken along lines 10—10.
Figure 11A:
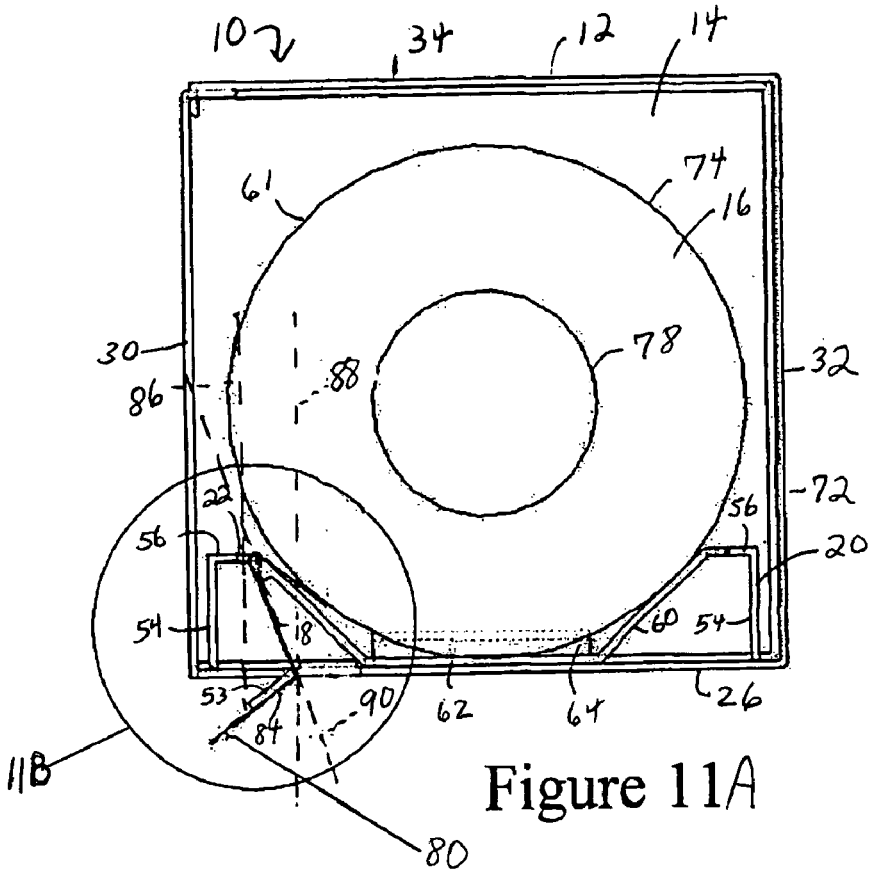
FIG. 11A is a sectional view similar to FIG. 10, but showing the path of sheet material as it moves from the roll and through the exit port.
Figure 11B:
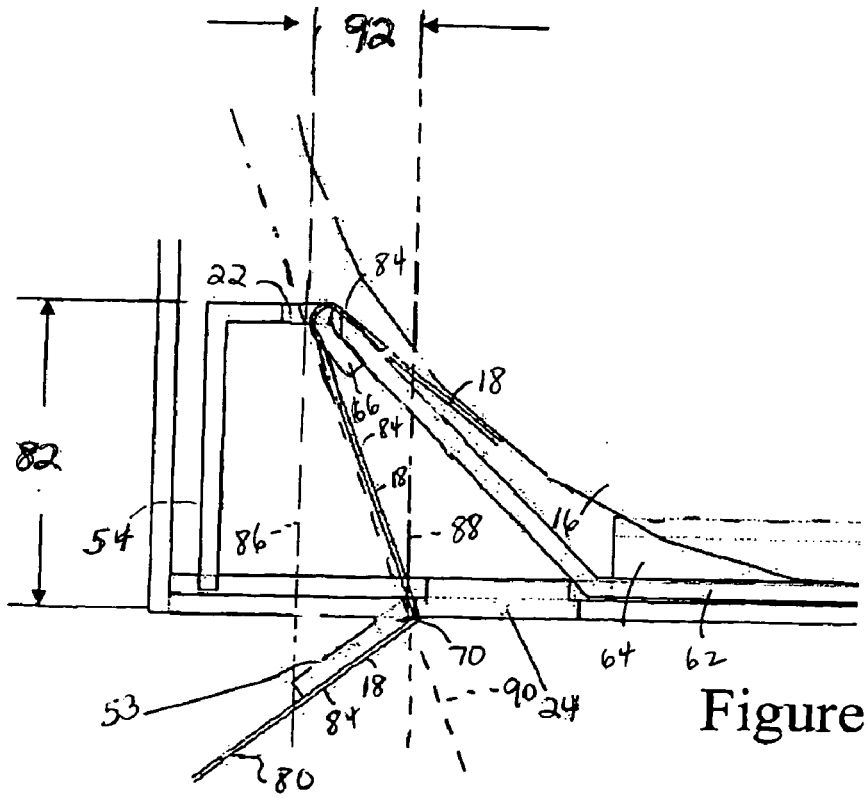
FIG. 11B is a partial view of the sectional view of FIG. 11A, taken along line 11B.

An embodiment of the dispenser of the present invention is generally illustrated in FIGS. 1–11B, which shows a dispenser 10 for rolled sheet material. As illustrated in FIGS. 1–7B, the dispenser 10 includes a dispenser housing 12. The dispenser housing 12 is configured as a single-use, non-reusable, disposable dispenser housing 12 which provides both a shipping carton and a dispenser housing. The dispenser housing 12 provides an internal compartment 14 and the housing 12 is configured to hold a rolled sheet material product, such as tissue, towels, and so forth, within the internal compartment 14. A roll 16 of sheet material 18 is desirably disposed upon a base or tray 20, as shown in FIGS. 3, 4, 10, 11A and 11B, which includes a dispensing port or opening 22 therein. The dispenser housing 12 includes an exit port 24, as shown in FIGS. 10, 11A and 11B, which is positioned, for example, in a lower end 26 thereof, although it will be understood that this position is not intended as a limitation, and the exit port 24 may be positioned on any area of the dispenser housing 12.

Figure 2:
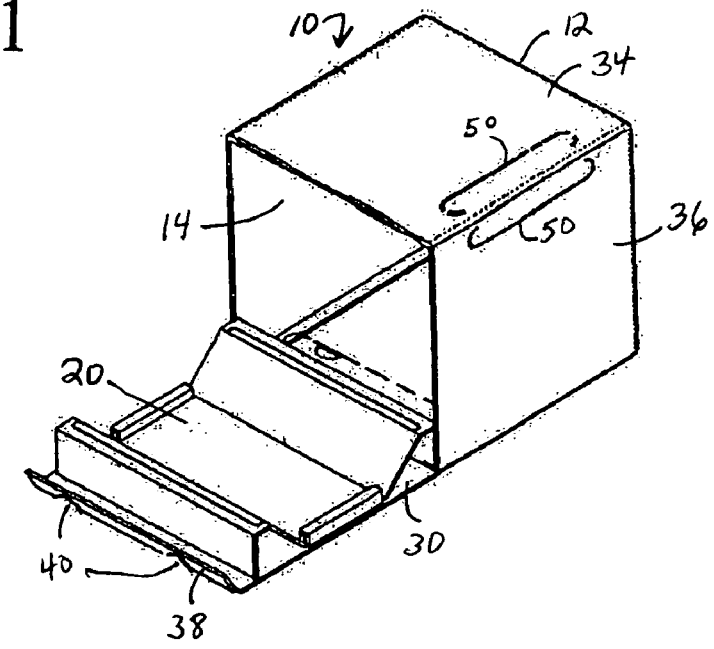
FIG. 2 is a perspective view of the dispenser of FIG. 1, but showing a front side opened and a tray positioned on the front side.
Figure 3:
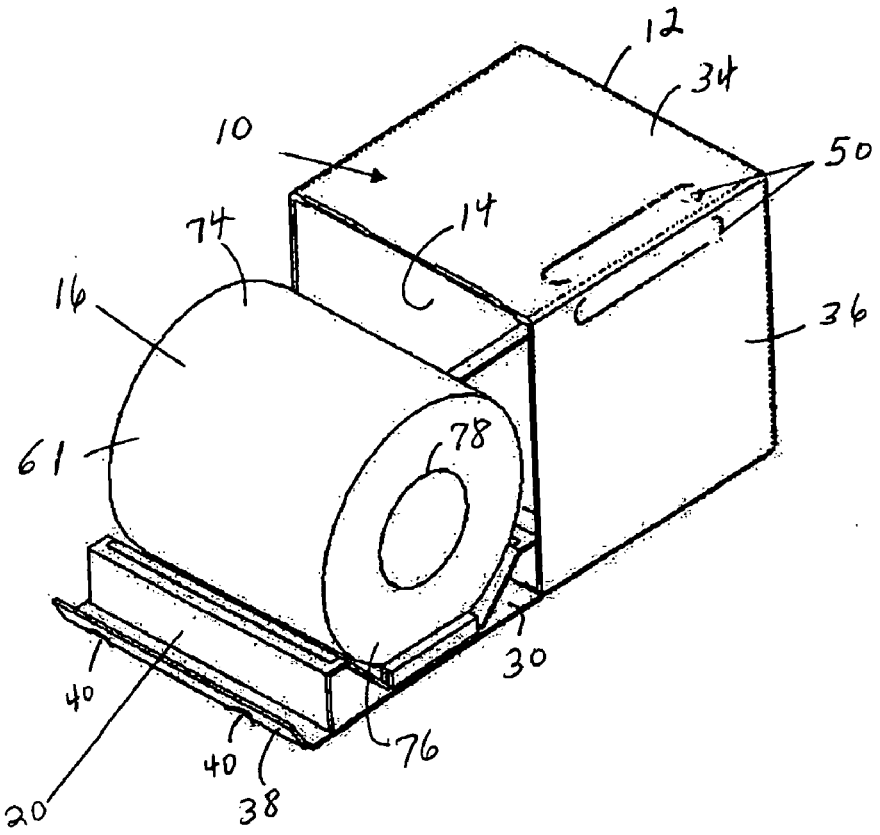
FIG. 3 is a perspective view similar to FIG. 2, but showing a roll of sheet material disposed on the tray.
Figure 4:
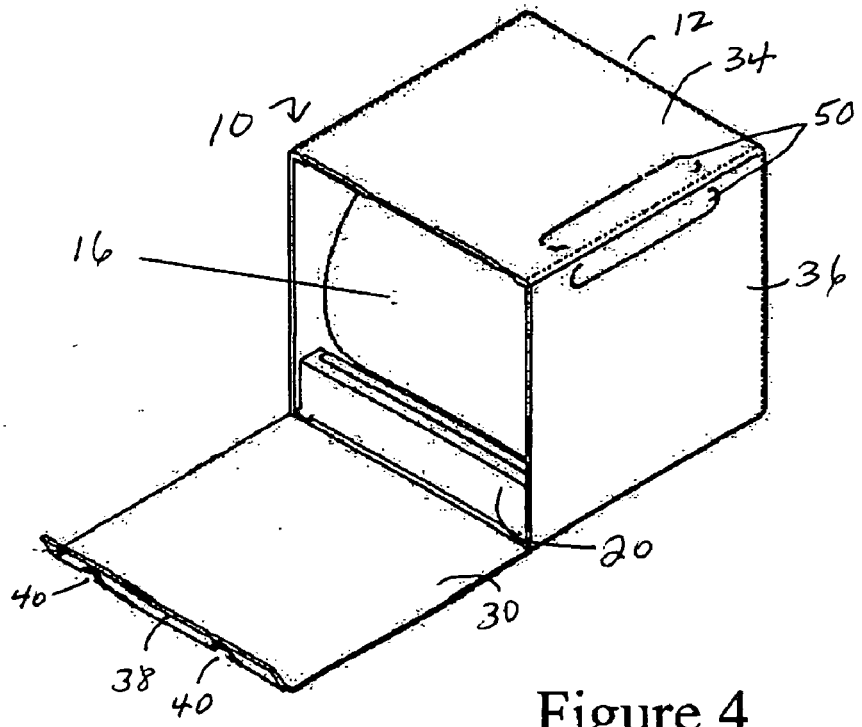
FIG. 4 is a perspective view similar to FIG. 1, but showing the tray and roll of sheet material positioned in the dispenser with the front side opened.
Figure 5:
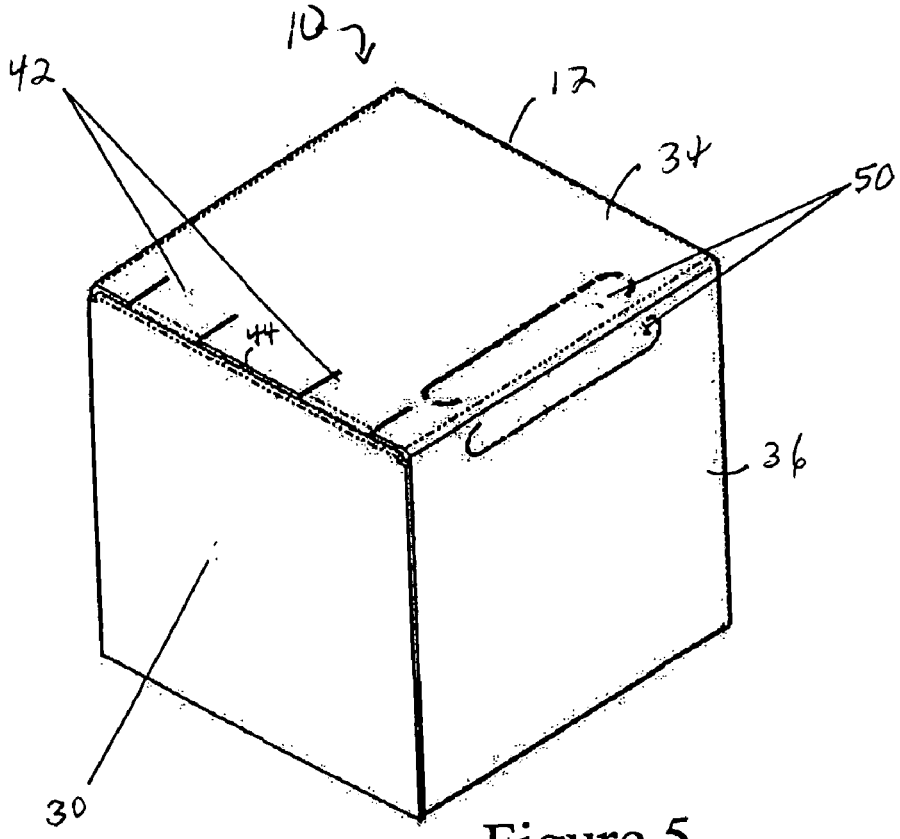
FIG. 5 is a perspective view similar to FIG. 1, but showing a portion of the locking tabs and the perforated portions which, when separated, provide a handle for the dispenser.
Figure 6:
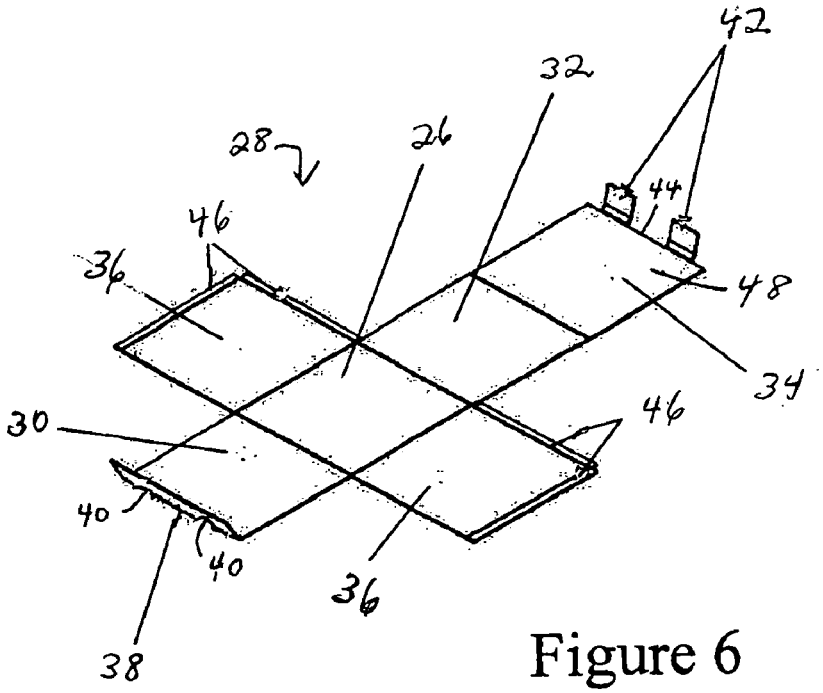
FIG. 6 is a perspective view of the blank used to provide a dispenser housing for the dispenser of FIGS. 1–5.

The dispenser housing 12 is provided from a pre-cut blank 28, and one non-limiting example is illustrated in FIG. 6. The blank 28 provides the lower end 26 in a central location, and extending to the front and back thereof are a front side 30 and a back side 32. An upper end 34 is connected to the back side 32. Also connected to the lower end 26 are opposing, spaced-apart left and right sides 36, all of which cooperate to form the housing 12. The front side 30 includes a flap 38 having a pair of slots 40. The upper end 34 includes a pair of locking tabs 42 which extend from one edge 44 (FIG. 5). The left and right sides 36 include glue tabs 46 (FIG. 6), which, in this embodiment, assist on holding the blank 28 into a generally square configuration to provide the housing 12. The blank 28 is then folded and adhered, taped, stapled, or otherwise attached to itself to desirably form a generally square box-shaped configuration, as illustrated generally in FIGS. 1–5, 7A, 7B, 10, 11A and 11B. As shown in FIGS. 2–4, the housing 12 provides a front side 30 opening to access the internal compartment 14 and the tray 20 and roll 16 of sheet material 18 therein. The flap 38 of the front side 30 fits against an inner surface 48 of the upper end 34. The locking tabs 42 extend into the slots 40 in the flap 38, to hold the housing 12 in a closed, dispensing position (FIG. 5). The locking tabs 42 and slots 40 in the flap 38 cooperate to provide a releasable lock to the dispenser housing 12. It will be appreciated that folds in the box, such as the folded area between the front side 30 and the lower end 26, may act as hinges, such as living hinges. It will be appreciated, however, that the housing is not intended as a limiting factor, and it will be understood that the housing may be provided in any configuration based on functional and/or aesthetic considerations.

Figure 7A:
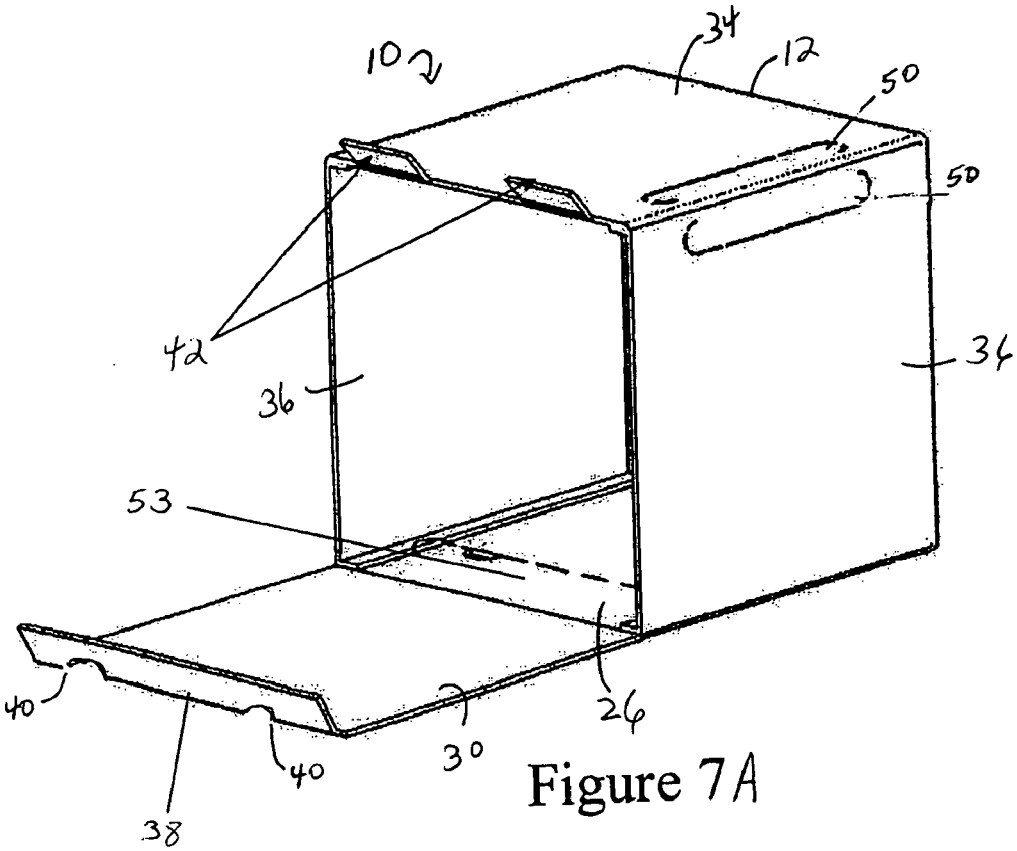
FIG. 7A is a perspective view the blank of FIG. 6 folded into the dispenser housing, showing locking tabs and corresponding slots in a flap.
Figure 7B:
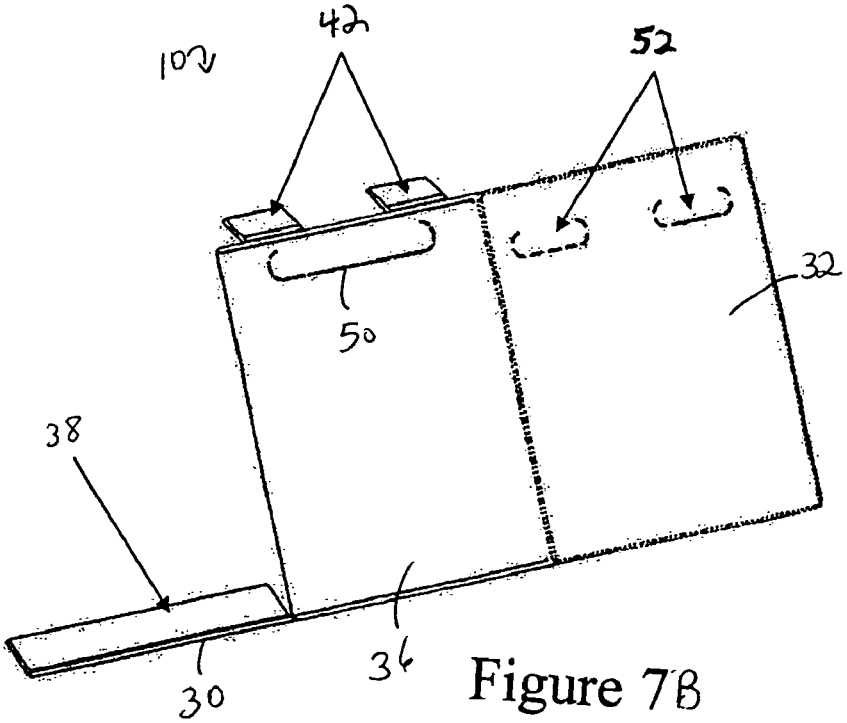
FIG. 7B is a side view of FIG. 6, but showing perforations for mounting openings.
Figure 8A:
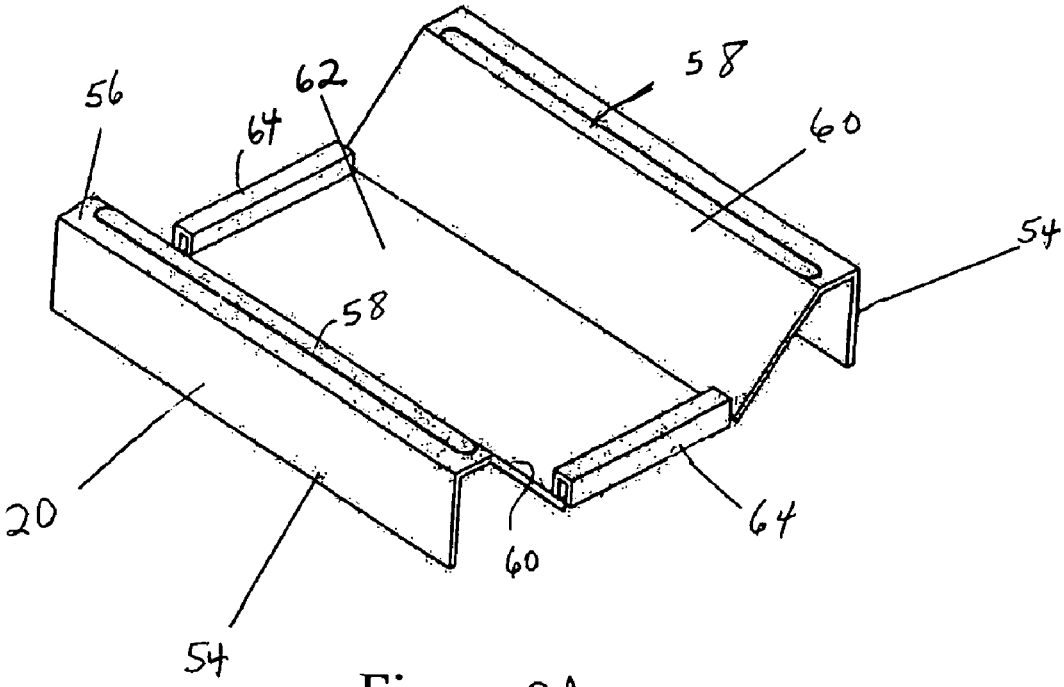
FIG. 8A is a perspective view of the tray shown in FIGS. 2–4.
Figure 8B:
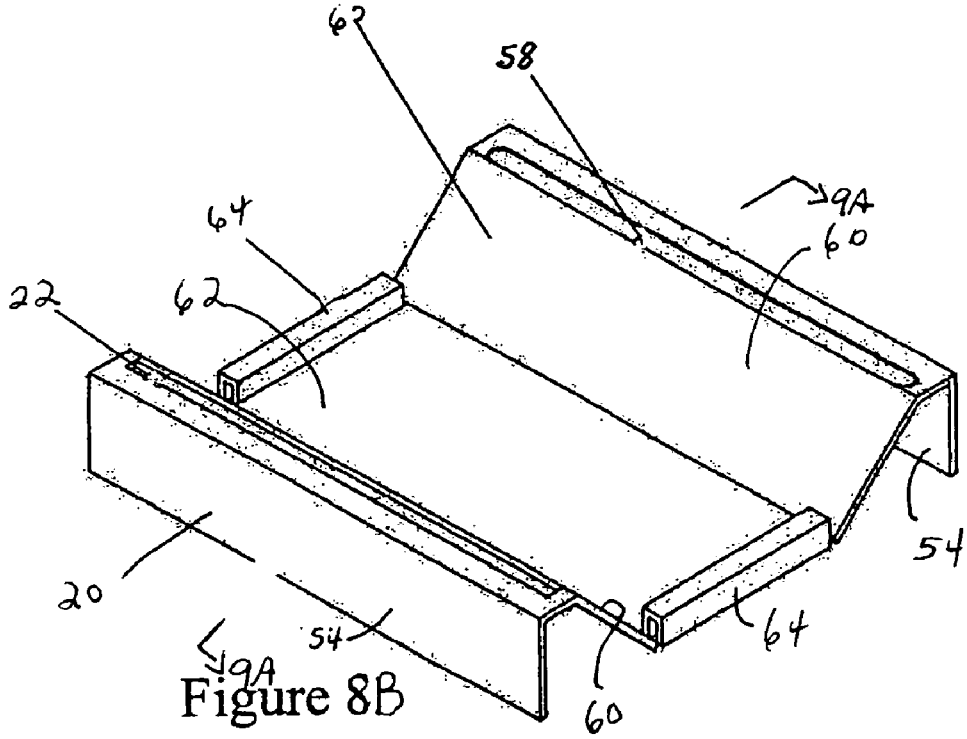
FIG. 8B is a perspective view similar to FIG. 8A, but showing the dispensing opening.

The housing 12 may include a pair of perforated portions 50 in adjoining sides, such as the upper end 34 and the right side 36 which, when pushed inward, cooperate to provide a carrying handle for the dispenser 10, as illustrated in FIGS. 1–5. Alternatively, however, the perforated portions may be formed such that they push outward and provide a carrying handle (not shown). The back side 32 may include perforated areas which, when pushed inward, cooperate to provide a mounting openings 52 for the dispenser 10, as shown in FIG. 7B. Alternatively, however, the dispenser housing 12 may be provided with attachment members (not shown) such as fasteners, hooks, hook and loop material (where one of the hook and loop material is positioned on the dispenser housing and the other hook and loop material is positioned on the surface to hold the dispenser housing), adhesives, and so forth. Further, while openings are illustrated on the back side 32, it will be understood that this is not a limitation, and the openings 52 and/or attachment members may be located on any portion of the dispenser housing 12. The lower end 26 may include a perforated member 53 which, when at least partially separated from the lower end 26, provides the exit port 24 (FIGS. 7A, and 10–11B).

The dispenser housing 12 may be made from any suitable material, or combination of materials. In the present invention, the dispenser housing 12 is desirably formed from a light weight material, such as, but not by way of limitation, paper, cardboard, paperboard, light weight fiber board, light weight plastic, polymer film, and any combination thereof.

The base or tray 20 is positioned adjacent the lower end 26 of the dispenser housing 12, as illustrated in FIGS. 4, 10, 11A and 11B, to hold at least a portion of a roll 16 of sheet material 18 within the internal compartment 14 provided therein. The tray 20, as shown in FIGS. 8A–9B, includes a pair of spaced-apart vertical members 54 which couple at an upper end thereof to horizontal top members 56. Each top member 56 includes an elongated perforated section 58. The top members 56 are coupled to a pair of spaced-apart angular members 60, which each slope downward and are coupled to horizontal base member 62. The base member 62 includes retention members 64 at opposing ends thereof.

The vertical members 54 control the height of the tray 20 and the base member 62. The base member 62 holds the roll 16 and the angular members 60 cooperate with the base member 62 to control radial movement of the roll 16 of sheet material 18 and to permit an outer circumference 61 of the roll 16 to unwind or rotate with minimal frictional resistance thereagainst, as shown in FIGS. 10–11B. Further, the angular members 60 cooperate to contain the radial movement of the roll 16. The retention members 64 cooperate to contain the axial movement of the roll 16, to further enhance the unwinding of the roll 16. Such features (base 62, angular members 60, retention members 64) cooperate to decrease bunching and/or jamming of the sheet material, thereby decreasing the likelihood of the sheet material breaking off within the dispenser housing and becoming inaccessible to a user.

The elongated perforated sections 58 of the top members 56, when separated, permit a tab 66 to desirably be pushed downward, which provides the dispensing opening 22. Alternatively, however, a pre-formed opening may be provided in the top member 56 to provide the dispensing opening 22 (not shown). As illustrated in FIGS. 9A and 9B, the tab 66 provides a smooth curved or radiused surface 68 over which sheet material 18 may travel without snagging or tearing. It will be appreciated that the tray 20 may be constructed from any material(s) described herein.

Similarly, the exit port 24 is provided when perforated member 53 is at least partially separated from the lower end 26 of the housing 12. The perforated member 53 is desirably pushed downward, away from the internal compartment 14. This action provides another smooth curved or radiused surface 70 over which sheet material 18 may travel without snagging or tearing, as shown in FIGS. 10 and 11B. Both the radiused surface 68 of the tab 66 and the radiused surface 70 of the perforated member 53 (FIGS. 9A–10 and 11B) are provided to reduce or eliminate frictional resistance which would result in early breaking or tearing of a sheet material being withdrawn by a user.

Perforations (perforated member 53) may be used to provide the exit port 24 and for other potential openings in the dispenser housing 12 so that when the housing 12 is used as a shipping carton, it is substantially closed. A substantially closed shipping carton is desirable to limit or prevent elements, such as liquid or moisture, from entering the housing 12. Moisture may inhibit the flow of sheet material from the dispenser 10. That is, when moisture enters the roll of sheet material, the sheet material may clump and unwind improperly. Perforations permit the dispenser with roll therein to be stored, and only when it is removed for use are the perforations opened and the sheet material threaded through the opening 22 and exit port 24 to permit the shipping carton to function as a one-use, disposable dispenser housing 12.

Alternatively, it will be understood that the opening 22 and/or the exit port 24 may be pre-formed without perforations (not shown). In such an alternative, the exit port 24 and/or any other openings provided by perforations may be covered by a release sheet (not shown) prior to the use of the shipping carton as a dispenser. In such an alternative, the sheet material may be threaded through the opening 22, or the opening 22 and the exit port 24, prior to shipment. In such an alternative, a leading edge of the sheet material may be folded down and held against an outer surface 72 of the lower end 26 of the dispenser housing 12 by a release sheet (not shown).

It will be appreciated that the surfaces 70, 68 of the perforated member 53 and/or tab 66, respectively, my be formed from the same material, or a different material than the material surrounding each. That is, for example, but not by way of limitation, the surfaces 70, 68 may include a polymer film disposed thereover; or, the surfaces may be coated with a substance that promotes the dispensing of the sheet material thereover.

Any portion of the dispenser housing 12 may include other features, such as a cut-away area (not shown) covered by a polymer film which permits maintenance personnel to monitor when the roll is close to depletion. Such a cut-away is desirably created when a tab formed by perforations is removed, or when an opening is covered by a clear, tinted and/or translucent material.

As illustrated in FIGS. 3–10, a roll 16 of sheet material 18 is configured to desirably provide a cylindrical body 74 positioned between flat ends 76. An opening or core 78 may extend through the center of each flat face 76. Alternatively, the roll 16 may be a coreless roll (not shown) which is provided without an opening extending therethrough. The roll 16 is designed, but not by way of limitation, to permit sheet material 18 to flow and be withdrawn from its outer periphery or outer circumference 61, resulting in a rotating movement of the roll on the tray 20.

As noted previously, the sheet material 18 may be a single ply product or a multiple ply product. The sheet material may have a single perforation or line of perforations (or a single weakened area or a line of weakness, such as a line of lower basis weight). Alternatively, a multiply sheet material product may include one or more perforations/lines of weakness that are offset relative to each other on two or more plies of the sheet material. One example of this offset is when a two ply sheet material product includes perforations/lines of weakness of the second ply located in a position approximately half-way between the perforations/lines of weakness of the first ply. When dispensed, desirably the first ply separates from the roll and half of the second ply is exposed for use. Such offset perforations/lines of weakness are known in the art, and are disclosed and described in detail in U.S. Pat. No. 3,877,576 issued to Kishi et al. and U.S. Pat. No. 3,770,172 to Nystrand, both of which are hereby incorporated by reference herein in their entirety for all purposes.

The roll 16 is positioned in the dispenser housing 12 such that the outer circumference 61 of the roll 16 is positioned against the base member 62 and the core 78 extends between the left and right sides 36, with a flat face 76 positioned adjacent each side 36, as generally illustrated in FIGS. 1, 10 and 11A. A leading edge 80 of sheet material is positioned through the opening 22 in the top member 56 and over the tab 66 and radiused surface 68 thereof, through the space or distance 82 between the top member 56 and the lower end 26, controlled by the vertical member 54, and through the exit port 24 and over the perforated member 53 and radiused surface 70 thereof (FIGS. 11A and 11B). The resistive tension on the sheet material perforations/lines of weakness is controlled by the winding, circuitous, or serpentine path 84 the sheet material 18 follows to and through the exit port 24. In this embodiment, the serpentine path 84 forms a generally "S" or "Z" shape.

A first axis 86 is positioned vertically through the dispensing opening 22, as shown in FIGS. 10, 11A and 11B. A second axis 88 is positioned vertically through the exit port 24; it is spaced-apart but parallel to the first axis 86. The sheet material 18 is withdrawn in a flat configuration (as compared to a centerflow roll, where the sheet material is bunched together and withdrawn from an inner periphery of the roll). The sheet material 18 flows through the dispensing opening 22 which is aligned with the first axis 86 and through the exit port 24 which is aligned with the second axis 88 on a third oblique axis 90 which intersects both the first and second axes 86, 88.

One control of the flow of sheet material 18 from the roll 16 and out of the dispenser 10 is by controlling a distance 92 between the first and second axes 86, 88. That is, tension or frictional resistance is controlled by the amount of alignment or non-alignment of the opening 22 and the exit port 24, as well as the distance 82 between the opening 22 and the exit port 24. Reducing the distance 92 between the first axis 86 and second axis 88 and therefore the amount of non-alignment between the opening 22 and the exit port 24 reduces the tension or frictional resistance. Increasing the distance 92 between the first axis 86 and the second axis 88 and therefore the amount of non-alignment between the opening 22 and the exit port 24 increases the tension or frictional resistance. Similarly, decreasing the distance 82 between the opening 22 and the exit port 24 decreases the tension or frictional resistance. Increasing the distance 82 between the opening 22 and the exit port 24 increases the tension or frictional resistance. Therefore, a sharply angled "S" or "Z" path 84 increases tension or frictional resistance, while a more widely angled "S" or "Z" path 84 decreases tension or frictional resistance.

It will be appreciated that different combinations may be used to obtain the desired tension or frictional resistance for appropriate withdrawal of the sheet material 18 from the roll 16, i.e., one sheet at a time. Such adjustability reduces waste from excessive dispensing and reduces frustration from sheet material which breaks off within the housing 12 and is therefore not available to be dispensed by a user. Such tension and frictional resistance control and adjustment may also be based upon the characteristics of the sheet material, such as, by way of non-limiting example, basis weight, caliper, machine direction tensile, tab strength, and so forth.

Adjustment to create less tension is used with a thinner, weaker, decreased basis weight and/or caliper sheet material, resulting in less tension and less frictional resistance to provide appropriate dispensing. Adjustment to create greater tension is used with a thicker, increased basis weight and/or caliper sheet material, resulting in greater tension and greater frictional resistance to permit appropriate dispensing.

In a system or method of use, a dispenser 10 having an exit port 24 is provided. Maintenance personnel open the dispenser housing 12 by removing the locking tabs 42 from the slots 40 in the flap 38 and by moving the front side 30 away from the remainder of the housing 12. The tab 66 of the perforated section 58 is pushed toward the lower end 26 of the housing 12 to provide the dispensing opening 22. The perforated member 53 in the lower end is also pushed outward, away from the housing 12, to provide the exit port 24. The leading edge 80 of the sheet material 18 is threaded through the opening 22 and the exit port 24, to extend a short distance from the housing 12, the sheet material flowing from the roll 16, through the opening 22 and exit port 24 in a flat configuration. The front side 30 is moved upward, toward the housing 12 such that the flap 38 is positioned against the inner surface 48 of the upper end 34. The locking tabs 42 are positioned in the slots 40 in the flap 38 to secure the dispenser housing 12 in a dispensing position. The dispenser 10 may then be mounted against a surface, if desired, via mounting openings or other attachment members (not shown).

While certain characteristics are described in a specific embodiment, any one or more characteristics, features, and/or elements may be used in any combination to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A disposable dispenser adapted to dispense sheet material, the dispenser comprising:

a housing configured to provide a shipping carton for a roll of sheet material as well as a dispenser housing for dispensing sheets of material therefrom, the housing including a tray configured to support sheet material thereon, the tray including a dispensing opening positioned on a first axis, the housing formed to include an exit port spaced apart from the tray, the exit port positioned on a second axis;

wherein sheet material disposed in the dispenser flows between the opening in the tray and the exit port on a third axis in a substantially flat configuration.

2. The disposable dispenser of claim 1, wherein the housing comprises a blank folded in a shipping carton which provides a dispenser housing.

3. The disposable dispenser of claim 1, wherein the exit port is provided in a lower end of the housing.

4. The disposable dispenser of claim 3, wherein a perforated member is provided in the lower end, the perforated member separated and moved downward to provide the exit port, and wherein when the perforated member is positioned to provide the exit port, the perforated member also provides a radiused surface over which sheet material flows from the dispenser.

5. The disposable dispenser of claim 1, wherein the tray controls radial and axial movement of the roll of sheet material.

6. The disposable dispenser of claim 5, wherein the tray includes a base and angular members which cooperate to control radial movement of a roll of sheet material and permit an outer circumference of a roll of sheet material to rotate with minimal frictional resistance thereagainst.

7. The disposable dispenser of claim 5, wherein the tray includes a base and retention members which cooperate to control axial movement of a roll of sheet material disposed in the dispenser.

8. The disposable dispenser of claim 5, wherein the tray includes a top member, and the top member includes a perforated section having a tab which, when the tab is separated and moved downward away from the top member, provides the dispensing opening and a radiused surface over which sheet material flows.

9. The disposable dispenser of claim 1, wherein the sheet material flows from the roll, through the dispensing opening and the exit port on a substantially circuitous path.

10. A disposable dispenser adapted to dispense sheet material, the dispenser comprising:

a housing configured to provide a shipping carton for a roll of sheet material as well as a dispenser housing for dispensing sheets of material therefrom, the housing including a tray configured to support sheet material thereon, the tray including a dispensing opening, the housing formed to include an exit port spaced apart from the tray;

wherein sheet material disposed in the dispenser follows a circuitous path between the opening in the tray and through the exit port in a substantially flat configuration.

11. The disposable dispenser of claim 10, wherein the housing comprises a blank folded in a shipping carton which provides a dispenser housing.

12. The disposable dispenser of claim 10, wherein the exit port is provided in a lower end of the housing.

13. The disposable dispenser of claim 12, wherein a perforated member is provided in the lower end, the perforated member separated and moved downward to provide the exit port, and wherein when the perforated member is positioned to provide the exit port, the perforated member also provides a radiused surface over which sheet material flows from the dispenser.

14. The disposable dispenser of claim 10, wherein the tray controls radial and axial movement of a roll of sheet material.

15. The disposable dispenser of claim 14, wherein the tray includes a base and angular members which cooperate to control radial movement of a roll of sheet material and permit an outer circumference of a roll of sheet material to rotate with minimal frictional resistance thereagainst.

16. The disposable dispenser of claim 14, wherein the tray includes a base and retention members which cooperate to control axial movement of a roll of sheet material disposed in the dispenser.

17. The disposable dispenser of claim 14, wherein the tray includes a top member, and the top member includes a perforated section having a tab which, when the tab is separated and moved downward away from the top member, provides the dispensing opening and a radiused surface over which sheet material flows.

18. The disposable dispenser of claim 10, wherein the opening in the tray is positioned on a first axis.

19. The disposable dispenser of claim 18, wherein the exit port is positioned on a second axis, and the second axis is spaced-apart and parallel to the first axis.

20. The disposable dispenser of claim 19, wherein the sheet material flows on a third axis which intersects both the first axis and second axis.

21. A system, comprising:

a disposable dispenser for dispensing sheet material comprising a housing configured to provide a shipping carton for a roll of sheet material as well as a dispenser housing for dispensing sheets of material therefrom, the housing including a tray configured to support sheet material thereon, the tray including a dispensing opening, the housing formed to include an exit port spaced apart from the tray, wherein sheet material disposed in the dispenser follows a circuitous path between the opening in the tray and through the exit port in a substantially flat configuration; and a roll of sheet material positioned on the tray.

22. The system of claim 21, wherein the exit port is provided in a lower end of the housing.

23. The system of claim 22, wherein a perforated member is provided in the lower end, the perforated member separated and moved downward to provide the exit port, and wherein when the perforated member is positioned to provide the exit port, the perforated member also provides a radiused surface over which sheet material flows from the dispenser.

24. The system of claim 21, wherein the tray controls radial and axial movement of the roll of sheet material.

25. The system of claim 24, wherein the tray includes a base and angular members which cooperate to control radial movement of the roll of sheet material and permit an outer circumference of the roll of sheet material to rotate with minimal frictional resistance thereagainst.

26. The system of claim 24, wherein the tray includes a base and retention members which cooperate to control axial movement of the roll of sheet material disposed in the dispenser.

27. The system of claim 24, wherein the tray includes a top member, and the top member includes a perforated section having a tab which, when the tab is separated and moved downward away from the top member, provides the dispensing opening and a radiused surface over which sheet material flows.

28. The system of claim 21, wherein the opening in the tray is positioned on a first axis.

29. The system of claim 28, wherein the exit port is positioned on a second axis, and the second axis is space-apart and parallel to the first axis.

30. The system of claim 29, wherein the sheet material flows on a third axis which intersects both the first axis and second axis.

* * * * *